US010053914B2

(12) United States Patent
Lehr et al.

(10) Patent No.: US 10,053,914 B2
(45) Date of Patent: Aug. 21, 2018

(54) METHOD AND APPLICATION FOR DIRECTIONAL DRILLING WITH AN ASYMMETRIC DEFLECTING BEND

(71) Applicant: BAKER HUGHES INCORPORATED, Houston, TX (US)

(72) Inventors: Joerg Lehr, Celle (DE); Bastian Sauthoff, Hannover (DE); Arne Deiters, Hannover (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 251 days.

(21) Appl. No.: 15/004,630

(22) Filed: Jan. 22, 2016

(65) Prior Publication Data

US 2017/0211330 A1 Jul. 27, 2017

(51) Int. Cl.

| | |
|---|---|
| ***E21B 7/08*** | (2006.01) |
| ***E21B 7/06*** | (2006.01) |
| ***E21B 7/28*** | (2006.01) |
| ***E21B 17/04*** | (2006.01) |

(52) U.S. Cl.

CPC ..... *E21B 7/067* (2013.01); *E21B 7/068* (2013.01); *E21B 7/28* (2013.01); *E21B 17/04* (2013.01)

(58) Field of Classification Search

CPC ... E21B 7/04; E21B 7/06; E21B 7/062; E21B 7/068; E21B 7/067

See application file for complete search history.

(56) References Cited

U.S. PATENT DOCUMENTS

| | | | | |
|---|---|---|---|---|
| 4,305,474 | A * | 12/1981 | Farris | E21B 7/068 175/107 |
| 5,421,420 | A * | 6/1995 | Malone | E21B 7/06 175/321 |
| 5,484,029 | A * | 1/1996 | Eddison | E21B 7/067 175/50 |
| 5,857,531 | A * | 1/1999 | Estep | E21B 4/02 175/101 |
| 8,360,172 | B2 | 1/2013 | Santelmann | |
| 2010/0025115 | A1 | 2/2010 | Kotsonis et al. | |
| 2014/0209389 | A1* | 7/2014 | Sugiura | E21B 7/067 175/73 |
| 2014/0284103 | A1 | 9/2014 | Niina et al. | |

* cited by examiner

*Primary Examiner* — Kenneth L Thompson

(74) *Attorney, Agent, or Firm* — Mossman, Kumar & Tyler, PC

(57) ABSTRACT

A method and related apparatus for forming a wellbore in a subterranean formation includes forming a drill string that has a drill bit at a distal end, a drilling motor configured to rotate the drill bit with a drive shaft; a joint coupled to the drive shaft; and an actuator assembly displacing the drive shaft between a first and a second deflection angle, the drive shaft being movable at each of the deflection angles until a predetermined weight is applied to the bit. The method also includes conveying the drill bit through the wellbore and fixing the drive shaft in at least one of the first and the second deflection angles by applying a predetermined weight on the bit.

15 Claims, 4 Drawing Sheets

METHOD AND APPLICATION FOR DIRECTIONAL DRILLING WITH AN ASYMMETRIC DEFLECTING BEND

BACKGROUND OF THE DISCLOSURE

1. Field of the Disclosure

This disclosure relates generally to oilfield downhole tools and more particularly to drilling assemblies utilized for directionally drilling wellbores.

2. Background of the Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

A substantial proportion of current drilling activity involves drilling deviated and horizontal wellbores to more fully exploit hydrocarbon reservoirs. Such boreholes can have relatively complex well profiles. The present disclosure addresses the need for steering devices for drilling such wellbores as well as wellbore for other applications such as geothermal wells, as well as other needs of the prior art.

SUMMARY OF THE DISCLOSURE

In aspects, the present disclosure provides an apparatus for forming a wellbore in a subterranean formation. The apparatus may have a drill string having a drill bit at a distal end, a drilling motor configured to rotate the drill bit with a drive shaft, a joint coupled to the drive shaft; and an actuator assembly. The actuator assembly may be configured to displace the drive shaft between a first and a second deflection angle. The drive shaft may be movable at each of the deflection angles until a predetermined weight is applied to the bit.

In aspects, the present disclosure also provides a method for forming a wellbore in a subterranean formation. The method may include forming a drill string that has a drill bit at a distal end, a drilling motor configured to rotate the drill bit with a drive shaft; a joint coupled to the drive shaft; and an actuator assembly displacing the drive shaft between a first and a second deflection angle, the drive shaft being movable at each of the deflection angles until a predetermined weight is applied to the bit. The method also includes the steps of conveying the drill string into the wellbore and fixing the drive shaft in at least one of the first and the second deflection angles by applying a predetermined weight on the bit.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

As will be appreciated from the discussion below, aspects of the present disclosure provide a rotary steerable system for drilling wellbores. In general, the described steering methodology involves deflecting the angle of the drill bit axis relative to the tool axis an between two stable angular positions.

Figure 1:
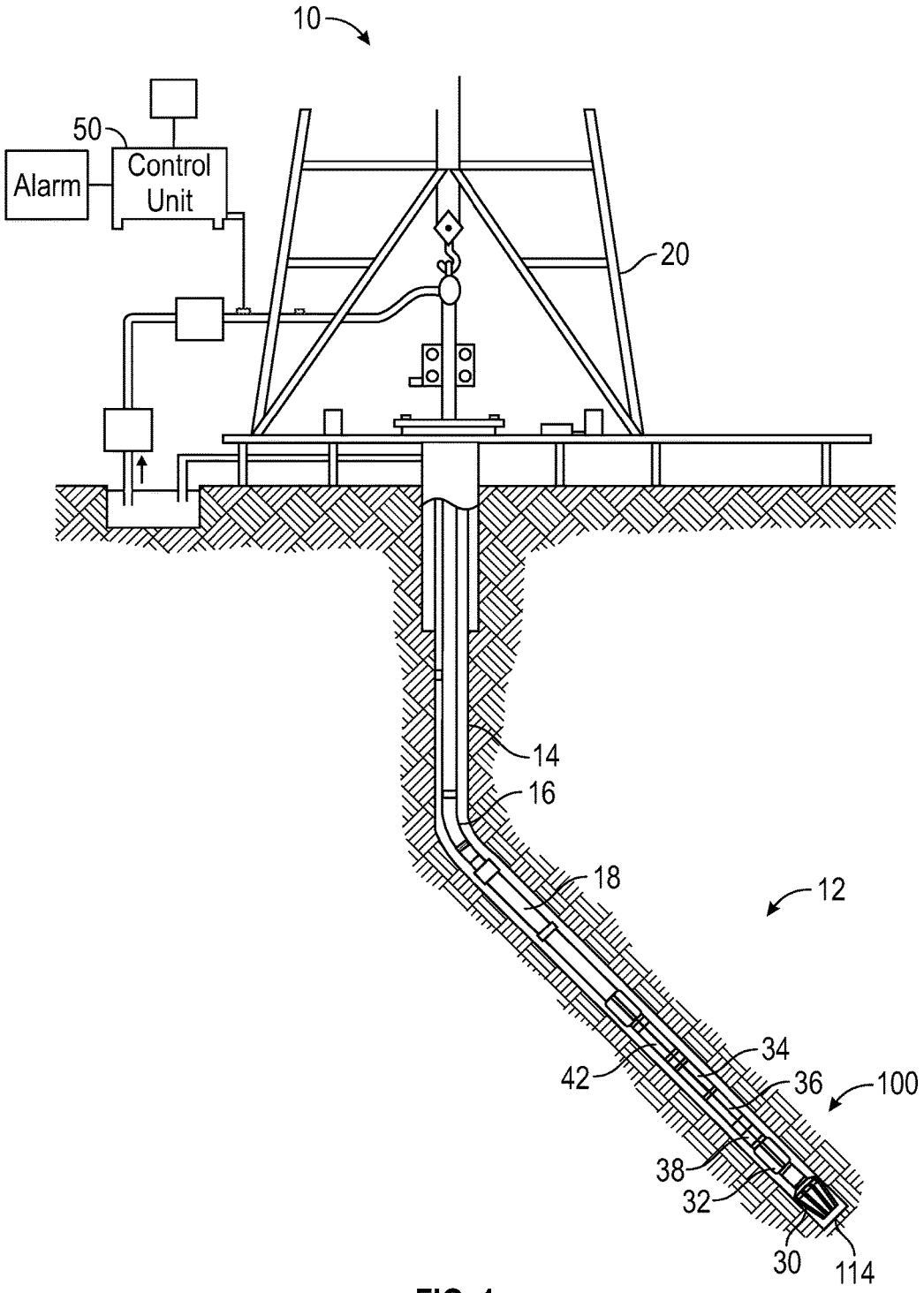
FIG. 1 illustrates a drilling system made in accordance with one embodiment of the present disclosure.

Referring now to FIG. 1, there is shown one illustrative embodiment of a drilling system 10 utilizing a steerable drilling assembly or bottomhole assembly (BHA) 12 for directionally drilling a wellbore 14. While a land-based rig is shown, these concepts and the methods are equally applicable to offshore drilling systems. The system 10 may include a drill string 16 suspended from a rig 20. The drill string 16, which may be jointed tubulars or coiled tubing, may include power and/or data conductors such as wires for providing bidirectional communication and power transmission. In one configuration, the BHA 12 includes a drill bit 30, a sensor sub 32, a bidirectional communication and power module (BCPM) 34, a formation evaluation (FE) sub 36, and rotary power devices such as drilling motors 38. The sensor sub 32 may include sensors for measuring near-bit direction (e.g., BHA azimuth and inclination, BHA coordinates, etc.) and sensors and tools for making rotary directional surveys. The-near bit inclination devices may include three (3) axis accelerometers, gyroscopic devices and signal processing circuitry. The system may also include information processing devices such as a surface controller 50 and/or a downhole controller 42. The drill bit 30 may be rotated by rotating the drill string 16 and/or by using a drilling motor 38, or other suitable rotary power source. By drilling motor 38, it is meant mud motors, turbines, electrically powered motors, etc. Communication between the surface and the BHA 12 may use uplinks and/or downlinks generated by a mud-driven alternator, a mud pulser and/or conveyed using hard wires (e.g., electrical conductors, fiber optics), acoustic signals, EM or RF. As will be discussed in greater detail below, the BHA 12 may include a deflector assembly 100 to steer the BHA 12.

Figure 2:
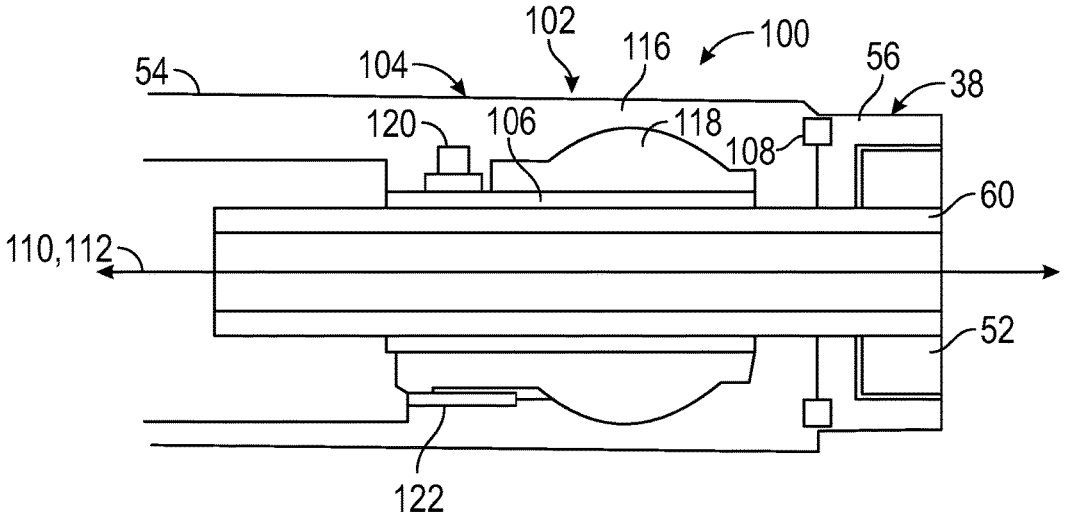
FIG. 2 schematically illustrates a bi-stable deflector assembly made in accordance with one embodiment of the present disclosure.

Referring to FIG. 2, there is sectionally illustrated a bi-stable deflector assembly 100 for directionally drilling a borehole in a subterranean formation. The deflector assembly 100 includes a joint 102, an actuator assembly 104, a joint bearing 106, and a momentum lock 108. The joint 102 allows a shaft 60 connected to a rotor 52 of the drilling motor 38 to be oriented by the actuator assembly 104. By orient, it is meant that the actuator assembly 104 can cause a specified angular deflection between a shaft axis 110 of the drive shaft 60 and a tool axis 112 as best seen in FIG. 4B. The axes 110, 112 may be generally aligned with the longitudinal axis of the wellbore (not shown). This angular deflection causes a bit face 114 (FIG. 1) to point in the desired drilling direction. The bit face 114 (FIG. 1) is generally the surface of the drill bit 30 that engages a bottom of the wellbore (not shown).

The joint 102 may include a ball case 116 that receives a ball 118. In one arrangement, the ball case 116 is formed in a sub 54 uphole of the drilling motor 38. The ball 118 seats around the joint bearing 106 and within the ball case 116. In another arrangement, the ball case 116 is formed in a housing 56 of the drilling motor 38. In both instances, a drive shaft 60 is disposed through the joint bearing 106 and the ball 118. The momentum lock 108 prevents relative angular rotation between the sub 54 and the housing 56.

Figure 3A:
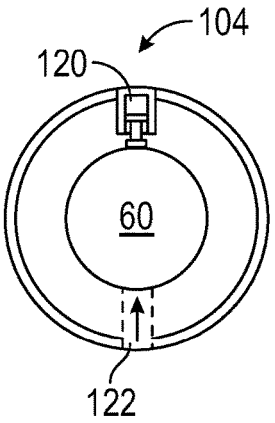
FIGS. 3A-C schematically illustrate various actuator assembly arrangements that may be used with a bi-stable deflector assembly made in accordance with one embodiment of the present disclosure.
Figure 3B:
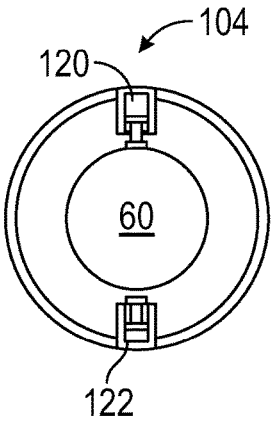
Figure 3C:
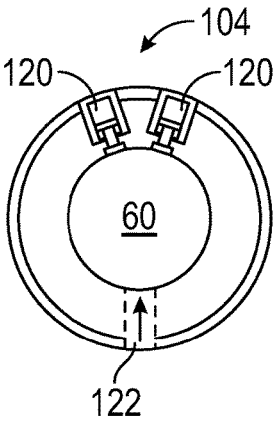

In one embodiment, the actuator assembly 104 may include a plurality of active and/or passive actuators 120, 122 configured to tilt the ball 118 to impart an angular deflection to the shaft 60. In the illustrated arrangement, actuator 120 may be an active actuator, such a piston, and the actuator 122 may be a passive actuator, such as a spring or other biasing member. Referring to FIGS. 3A-C, there are shown non-limiting variants of actuator assemblies 104 that may be used according to the present teachings. FIG. 3A shows an arrangement wherein the active actuator 120 is a hydraulically actuated piston that deflects the shaft 60 a specified amount and the passive actuator 122 is a spring that biases or urges the shaft 60 toward the active actuator 120. FIG. 3B shows an arrangement wherein the active actuator 120 is a hydraulically actuated piston that deflects the shaft 60 a predetermined amount and the passive actuator 122 is a hydraulically actuated piston that functions as a stop that prevents the shaft 60 from radially deflecting more than a specified amount. The amount of radial deflection can be controlled by appropriately sizing a gap 70 between the passive actuator 122 and the shaft 60. FIG. 3C shows an arrangement wherein two active actuators 120 can independently or cooperatively deflect the shaft 60 a specified amount and the passive actuator 122 biases or urges the shaft 60 to the active actuators 120. It should be noted that the actuators 120, 122 are set to oppose one another (i.e., one hundred eighty degrees apart) and thereby applying opposing forces to the shaft 60.

Figure 4A:
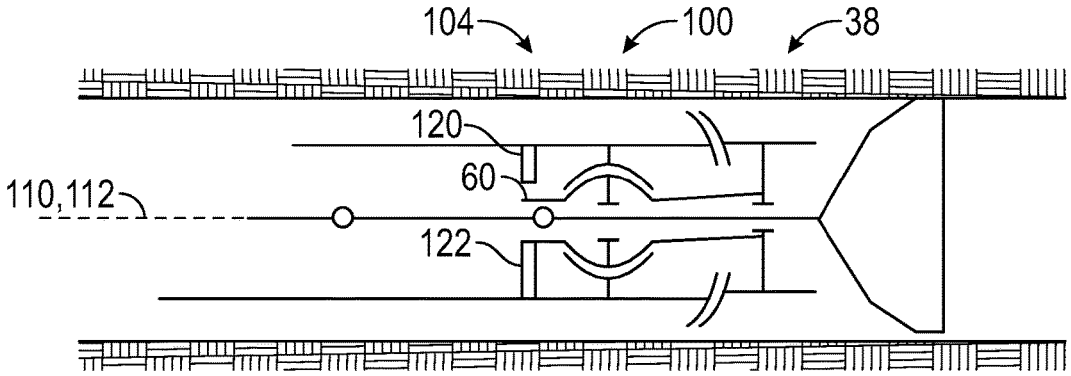
FIGS. 4A & B schematically illustrate a bi-stable deflector assembly in accordance with one embodiment of the present disclosure that is configured for straight drilling and deviated drilling, respectively.
Figure 4B:
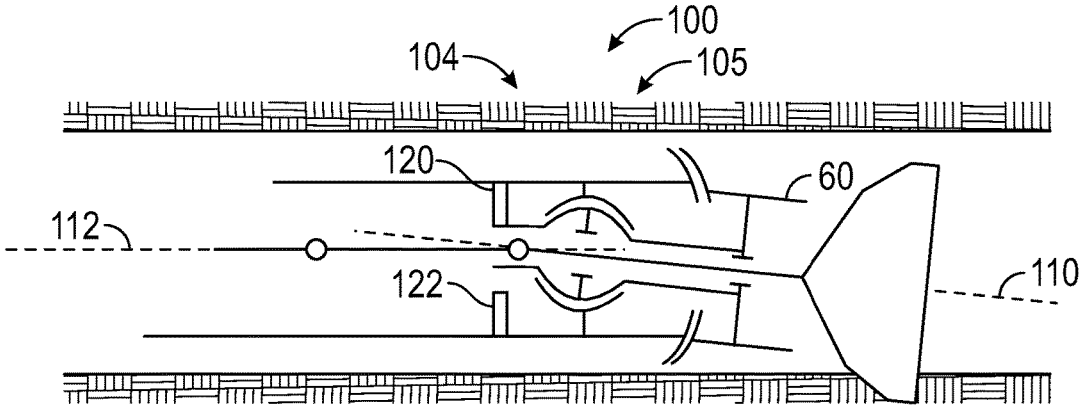

Referring to FIGS. 4A,B, in embodiments, the deflector assembly 100 may be configured to impose two discrete deflection angles. The first angle may be for straight drilling and set at zero or a small amount to counteract gravity (e.g., 0.5 degrees). The second angle may be for direction drilling and set at a non-zero value such as five degrees. In arrangements, the deflector assembly 100 is stable at only these two angular deflections. That is, the deflection angle is always at or moving toward one of these two values and is not stable at an intermediate deflection angle value. The deflector assembly 100 may have suitable electronics (not shown) to allow control (e.g., activation and de-activation) using the surface controller 50 (FIG. 1) and/or a downhole controller 42 (FIG. 1).

FIG. 4A show the deflector assembly 100 positioned uphole of the drilling motor 38 and configured for straight drilling. By "uphole," it is meant between the drilling motor 38 and the surface as opposed to between the drilling motor 38 and the drill bit 30 (FIG. 1). In FIG. 4A, the actuators 120, 122 are set to impose a zero deflection angle to the drive shaft 60. Alternatively, a small angle, e.g., −0.5 degrees relative to the tool axis 112, may be applied by the actuators 120, 122 to counteract gravity. FIG. 4B shows the deflector assembly 100 imposing a specified deflection angle (e.g., 4 degrees). This deflection angle is imposed by the active actuator 120 pressing and displacing the drive shaft 60, which then tilts or rotates the drive shaft 60 at the joint 104. The passive actuator 122 resists the displacement and may prevent a deflection beyond a predetermined value.

FIG. 4A show the deflector assembly 100 positioned uphole of the drilling motor 38 and configured for directional drilling. By "uphole," it is meant between the drilling motor 38 and the surface as opposed to between the drilling motor 38 and the drill bit 30 (FIG. 1). In FIG. 4A, the actuators 120, 122 are set to have the self-stable idle position where the drive shaft 60 has a small deflection angle, e.g. 1 degree skew relative to the tool axis 112. The preset deflection angle will be used to counteract gravity of the BHA in homogenous formations and/or to be able to work against formation tendencies (formation dip). The pre-adjusted deflection angle will be oriented from 0-360° in drilling direction (tool face); e.g., setting the tool face angle to 180° to work against a pushing up dip in the formation or to compensate a left hand walk tendency by orienting the deflection in direction of 90° tool face. For rigid tubulars such as drill pipe, the tool face angle may be set by rotating the drill string. OF non-rigid tubulars such as coiled tubing, an orienting module integrated into the BHA may be used to rotate the section of the BHA that includes the deflector assembly 100. Of course, any angle may be used for the tool face angle (131° toolface). The preset deflection angle is supported by a passive actuator (e.g., a spring 120) or an active actuator (e.g., hydraulic piston 122) pressing and displacing the drive shaft 60, into the idle position, while running the BHA in hole and/or orienting the bit off bottom according to the desired tool face, before drilling weight is applied.

When the bit reaches bottom and contacts a bottom face of the wellbore and weight on bit (WOB) is applied, the preset deflection angle position will be secured by the resulting vector in opposite direction of the deflection in addition. This position is called the idle stable condition. It should be noted that the contact between the actuator, whether passive or active, and the shaft 60 does not fix the preset deflection until WOB is applied. That is, the shaft 60 may, at times, not contact the actuators until the appropriate WOB is applied. Thus, the shaft 60 is movable relative to the actuators. Therefore, the deflection may be less than the desired preset deflection prior to application of the appropriate WOB.

Referring to FIGS. 1, and 4A,B, several modes of operation may be used in conjunction with the deflector assembly 100. In a "sliding" mode of drilling, only the drilling motor 38 rotates the drill bit 30. In this mode, a straight hole having a diameter the same size as the drill bit 30 is obtained by using the first stable deflection angle, either zero or a small angle to compensate for gravity. A maximum build-up date is obtained by activating the actuator assembly 104 to obtain the second stable deflection angle. Here, the drilled hole has the same diameter as the drill bit 30.

Referring to FIGS. 1, and 4A,B, several modes of operation may be used in conjunction with the deflector assembly 100. In a "sliding" mode of drilling, only the drilling motor 38 rotates the drill bit 30. In this mode, a build section or a straight horizontal section is formed using one degree of freedom, combined with slight meandering in another degree of freedom, which results in a bore having a diameter the same size as the drill bit 30.

A maximum build-up rate is obtained by activating the opposite active actuator assembly 104 to obtain the second stable deflection angle (e.g., 3 degree) or build angle. Here, the drilled hole has the same diameter as the drill bit 30 as well. The applied WOB applied to the bit generates a vector in opposite direction of the deflection and secures the build angle. After the WOB has been applied, the active actuator assembly 104 may be deactivated to allow the applied WOB to principally fix the build angle. By principally, it is meant provide a majority of the force to fix the build angle. Thus, the active actuator assembly 104 moves the shaft 60 to the build angle, but is not required to maintain the build angle once the appropriate WOB is applied.

Switching between idle stable and build stable condition is called a Bi-Stable system and Bi-Stable operation mode to drill complex well trajectories and avoid Non Productive Time (NPT) for system adjustments on surface.

Drilling a close to straight hole and enabling power transmission from a rotating drill string in addition to the downhole motor power, will be preferable done in idle position (e.g., 1 degree deflection). Here, the drilled hole has a slight bigger diameter as the drill bit 30, less vibration in the BHA and better hole quality for cementation later on in comparison to rotary drilling with a (e.g., 3 degree deflection).

Deactivating all actuators allows pull-out-of-hole (POOH) with a self-aligning system and enables to pass well bore restrictions e.g. due to break outs or local swelling of the formation.

Selectively activating the actuators 122 and 104 also allows using the motor as reaming tool. Activating the actuator 122 will allow medium size hole enlargement and activating the actuator 104 enables maximum hole enlargement of desired part of the section of the wellbore in rotary mode. The operation in sliding mode only, enables local or sectional well bore wall maintenance; e.g., to bring an "egg" or oval shaped wellbore cross section back close to round, or a round into a defined egg shape, e.g., to ease casing or liner installation.

It should be appreciated that the deflector assemblies according to the present disclosure may be used to drill a complex wellbore without having to retrieve the drill string from the wellbore. A complex wellbore may be defined as a wellbore having at least one section having bend radius. The deflector assembly may be tripped into the well in a deactivated condition. Next, the deflector assembly may be activated to provide maximum deflection. Once the bend section is complete, the deflector assembly may be deactivated to allow straight drilling. This process may be continued to provide addition bend radius sections.

In a "rotary" mode of drilling, the entire drill string 16 rotates to rotate the drill bit 30. The drilling motor 38 may or may not also rotate the drill bit 30. In this mode, a straight hole having a diameter the same size as the drill bit 30 is obtained by using the first stable deflection angle that is zero. A straight hole having a diameter the slightly larger than the drill bit 30 is obtained by using the first stable deflection angle that has a small angle to compensate for gravity. This occurs because the drill bit 30 has a slight orbit around the drill string 16. An even larger drilled hole size is obtained if the actuators are set to obtain the second stable deflection angle.

In a "cleaning" mode of drilling, the entire drill string 16 rotates to rotate the drill bit 30 while the drill string 16 is pulled out of the wellbore 14. As in the "rotary" mode, the drilled hole will have a diameter the same size as the drill bit 30 if the first stable deflection angle is zero or may be cleaned if already at the larger size. Similarly, using the first stable deflection angle that has a small angle to compensate for gravity results in a straight hole with a diameter the slightly larger than the drill bit 30 or a cleaning effect if already at the larger size. The same result occurs if the actuators are set to obtain the second stable deflection angle.

There are a number of permutations for arrangements using passive and active actuators in order to move the shaft axis between two stable deflection angles. For example, a fixed block and a biasing device may be used to fix a zero or near zero deflection angle and a piston may be used to displace the drive shaft to the second deflection angle. In another embodiment, an adjustable fixed block may be with the biasing device. In another arrangement, the biasing device fixes the zero or near zero deflection angle and a piston and the fixed block to obtain the second deflection angle. Still another embodiment may use two active actuators to set the zero or near zero deflection angle and the second deflection angle. In still another embodiment, the solid block may be used to fix a specified angle for the drive shaft.

Figure 5A:
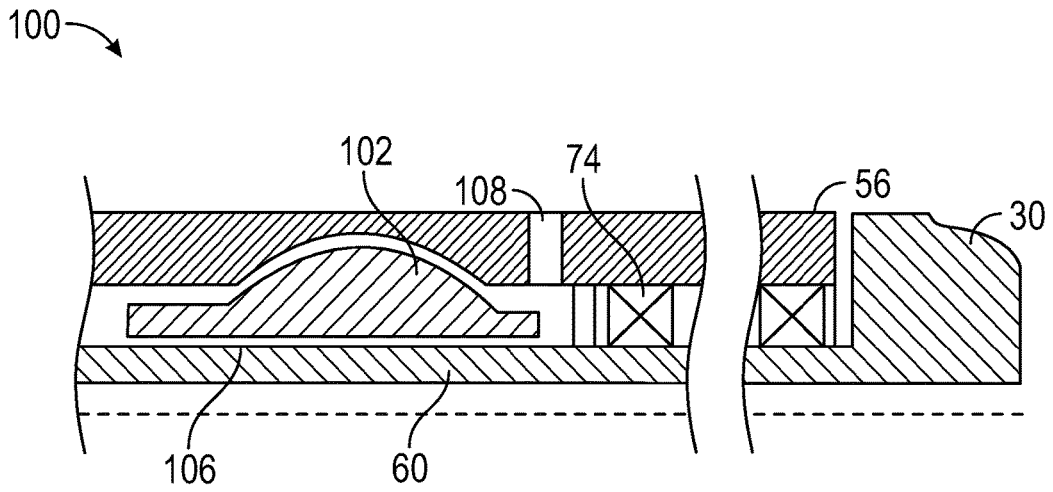
FIGS. 5A & 5B schematically illustrate various arrangements for a momentum lock made in accordance with one embodiment of the present disclosure.
Figure 5B:
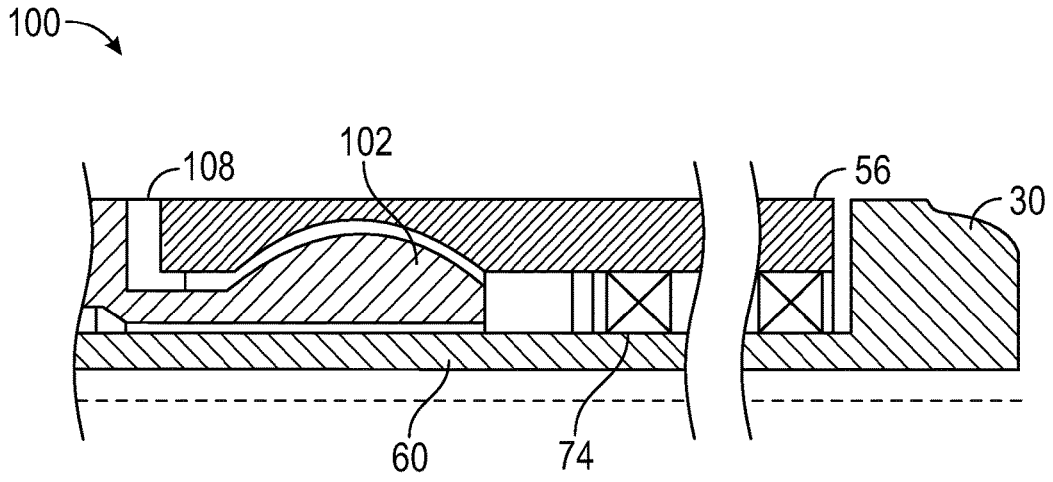

Referring to FIGS. 5A and 5B, there are shown variations for positioning the momentum lock 108 relative to the joint 102. The momentum lock 108 may be formed using a friction lock or a form fit. In FIG. 5A, there is shown the drill bit 30, the drive shaft bearings 74, the drive shaft 60, the joint 102, the bearing 106, and the momentum lock 108. In this embodiment, the joint 102 is positioned external to the drilling motor housing 56. In FIG. 5B, there is also shown the drill bit 30, the drive shaft bearings 74, the drive shaft 60, the joint 102, the bearing 106, and the momentum lock 108. In this embodiment, the joint 102 is positioned internal to the drilling motor housing 56.

While the foregoing disclosure is directed to the one mode embodiments of the disclosure, various modifications will be apparent to those skilled in the art. It is intended that all variations within the scope of the appended claims be embraced by the foregoing disclosure.

The invention claimed is:

1. An apparatus for forming a wellbore in a subterranean formation, comprising:

a drill string having a drill bit at a distal end;

a drilling motor configured to rotate the drill bit with a drive shaft;

a joint coupled to the drive shaft; and an actuator assembly displacing the drive shaft between a first and a second deflection angle, the drive shaft being movable at each of the deflection angles until a predetermined weight is applied to the bit, wherein the drive shaft is fixed in at least one of the first and the second deflection angles when a predetermined weight is applied to the drill bit.

2. The apparatus of claim 1, wherein the actuator assembly includes a first and a second actuator arranged in an opposing fashion.

3. The apparatus of claim 2, wherein the drive shaft has the first deflection angle when the second actuator is deactivated.

4. The apparatus of claim 3, wherein the drive shaft has the second deflection angle when the second actuator is activated.

5. The apparatus of claim 2, wherein the first actuator is configured to provide a non-zero first deflection angle.

6. The apparatus of claim 2, wherein the first actuator urges the drive shaft to the first deflection angle after the second actuator is deactivated and the predetermined weight on the drill bit is removed.

7. The apparatus of claim 2, wherein the first actuator is passive and the second actuator is active.

8. A method for forming a wellbore in a subterranean formation, comprising:

forming a drill string having a drill bit at a distal end; a drilling motor configured to rotate the drill bit with a drive shaft; a joint coupled to the drive shaft; and an actuator assembly displacing the drive shaft between a first and a second deflection angle, the drive shaft being movable at each of the deflection angles until a predetermined weight is applied to the bit;

conveying the drill string into the wellbore; and fixing the drive shaft in at least one of the first and the second deflection angles by applying a predetermined weight on the bit.

9. The method of claim 8, configuring the actuator assembly to maintain the drive shaft in the first deflection angle before the drill bit contacts a wellbore bottom.

10. The method of claim 8, further comprising:

rotating the drill bit with only the drilling motor.

11. The method of claim 10, wherein the drive shaft is in the first deflection angle; and further comprising drilling a substantially straight section of the wellbore.

12. The method of claim 10, wherein the drive shaft is in the second deflection angle; and further comprising drilling a deviated section of the wellbore.

13. The method of claim 8, further comprising:

rotating the drill bit with the drilling motor and the drill string.

14. The method of claim 13, further comprising drilling the wellbore to a diameter larger than a diameter of the drill bit.

15. The method of claim 13, wherein the drill bit changes an already drilled wellbore by one of: (i) changing a shape, and (ii) increasing a diameter.

* * * * *